US007818906B2

(12) United States Patent
Hansen et al.

(10) Patent No.: US 7,818,906 B2
(45) Date of Patent: Oct. 26, 2010

(54) LIGHTBOX

(75) Inventors: Juergen Hansen, Duesseldorf (DE); Peter Zoeller, Duesseldorf (DE)

(73) Assignee: CCS digital_fabric GmbH, Duesseldorf (DE)

( * ) Notice: Subject to any disclaimer, the term of this patent is extended or adjusted under 35 U.S.C. 154(b) by 712 days.

(21) Appl. No.: 11/723,955

(22) Filed: Mar. 22, 2007

(65) Prior Publication Data

US 2008/0010878 A1 Jan. 17, 2008

Related U.S. Application Data

(60) Provisional application No. 60/791,956, filed on Apr. 14, 2006.

(30) Foreign Application Priority Data

Mar. 24, 2006 (DE) ..... 20 2006 004 895 U
Feb. 5, 2007 (EP) ..... 07101754

(51) Int. Cl.
*G09F 13/04* (2006.01)

(52) U.S. Cl. ..... 40/541; 40/564

(58) Field of Classification Search ..... 40/541, 40/564, 571, 572; 362/812
See application file for complete search history.

(56) References Cited

U.S. PATENT DOCUMENTS

| | | | | | |
|---|---|---|---|---|---|
| 1,993,136 | A * | 3/1935 | Fuller | 40/572 |
| 2,119,931 | A * | 6/1938 | Smith | 40/571 |
| 2,145,955 | A * | 2/1939 | Smith | 40/571 |
| 2,858,629 | A * | 11/1958 | Carter | 40/367 |
| 3,231,996 | A * | 2/1966 | Krauss | 40/571 |
| 4,261,125 | A * | 4/1981 | Rappaport | 40/367 |
| 5,020,254 | A | 6/1991 | Sheppard | |
| 5,519,595 | A * | 5/1996 | Wang | 362/234 |
| 5,566,483 | A * | 10/1996 | Ogren | 40/564 |
| 6,098,326 | A * | 8/2000 | Campbell, III | 40/575 |
| 6,401,373 | B1 * | 6/2002 | Sexton | 40/576 |

FOREIGN PATENT DOCUMENTS

| | | |
|---|---|---|
| DE | 6950098 | 5/1970 |
| DE | OS2248407 | 4/1974 |
| DE | 9002394.3 | 6/1990 |
| DE | 3903840 | 8/1990 |
| DE | 19903483 | 8/2000 |
| GB | 2080005 | 1/1982 |

* cited by examiner

*Primary Examiner*—Cassandra Davis
(74) *Attorney, Agent, or Firm*—Berenato & White, LLC

(57) ABSTRACT

A light box with at least three base profiles which in the assembled state form a closed base frame onto which a first tensible plane material to be illuminated can be fitted such that it forms the front side of the base frame, at least one illuminant which is disposed within the base frame in order to illuminate the light box, at least one power supply, in particular an electrical series connection unit in order to supply the illuminant with current, at least one supporting wall disposed on the rear side of the base frame which has at least one attachment for releasably fixing the illuminant and/or the electrical series connection unit within the base frame, the supporting wall being formed by a second tensible plane material which can be attached to the base frame such that it forms the rear side of the light box.

15 Claims, 4 Drawing Sheets

LIGHTBOX

CROSS-REFERENCE TO RELATED APPLICATIONS AND CLAIM TO PRIORITY

Figure 1:
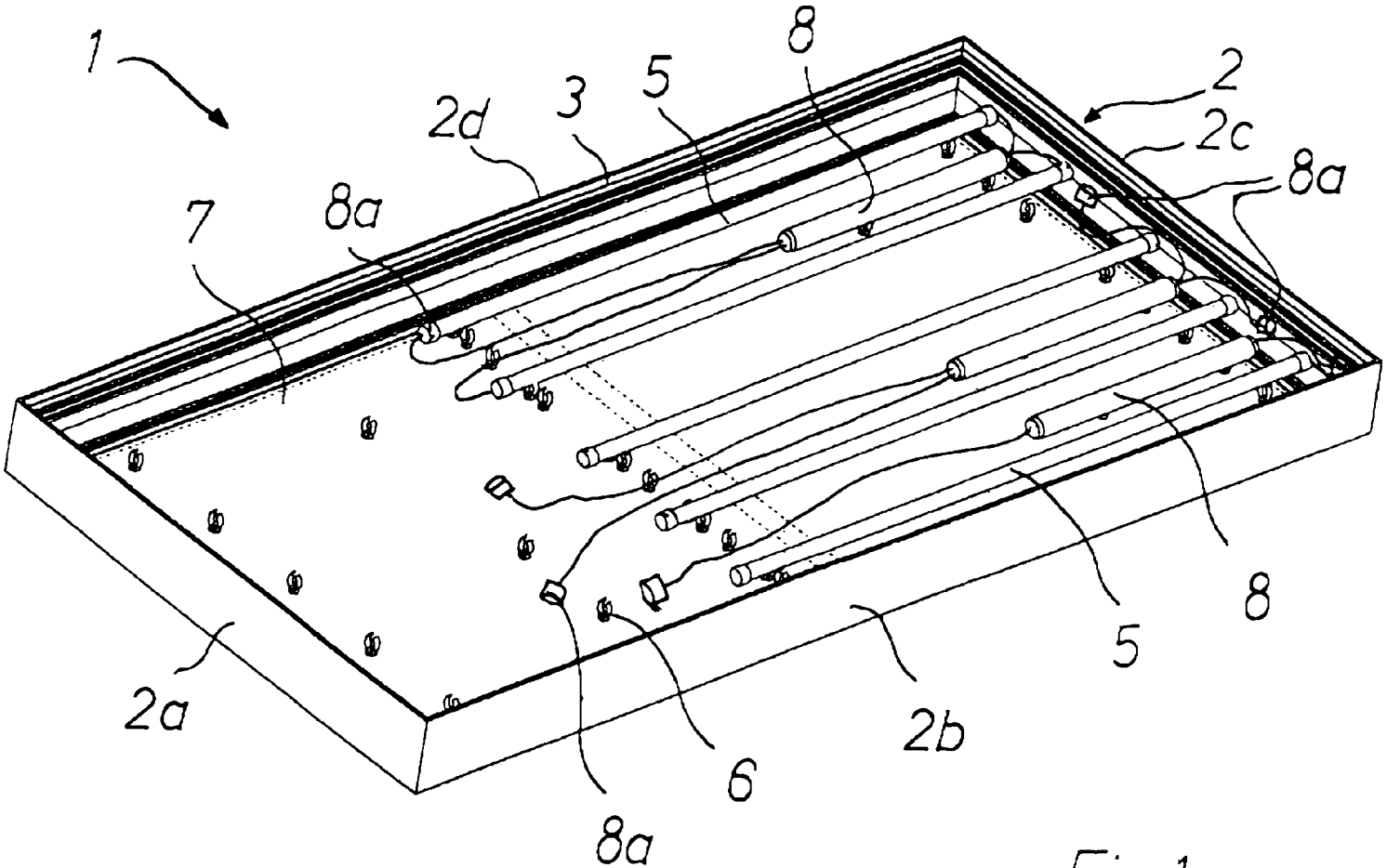

This application relates to German Patent Application No. 202006004895.2 filed Mar. 24, 2006; European Patent Application No. 07101754.5 filed Feb. 5, 2007; and U.S. Provisional Patent Application No. 60/791,956 filed Apr. 14, 2006, of which the disclosures are incorporated herein by reference and to which priority is claimed.

The present invention relates to a light box with at least three base profiles which in the assembled state form a closed base frame onto which a first tensible plane material to be illuminated can be fitted such that it forms the front side of the base frame. The light box has at least one illuminant which is disposed within the base frame in order to illuminate the light box, and at least one power supply, in particular an electronic series connection unit in order to supply the illuminant with current, and at least one supporting wall disposed on the rear side of the base frame which has at least one attachment means for releasably fixing the illuminant and/or the electronic series connection unit within the base frame.

Light boxes of the type specified at the start are generally known and described, for example, in G 9002394 U1. This document discloses a light box for use with illuminated advertising which has a base frame with at least one interchangeable rigid advertisement support panel. The base frame is formed from profile bars which have securing means that engage with one another by form fit and/or force fit so as to be attached to one another. The advertising print is changed by changing the advertisement support panel which is fitted between a blind frame, which is also rigid, and the base profile. For this, the blind frame is first of all released from the base frame by a applying force, the old rigid advertisement support panel is then removed and replaced by a new advertisement support panel which is also rigid, and finally the blind frame is attached to the base frame again by means of the engagement system.

A disadvantage with this system, on the one hand, is that the geometrical dimensions are already established when the base frame is manufactured and can not be changed at a later state. On the other hand, these light boxes are almost exclusively dispatched in an assembled state, and this makes a handling more difficult and is associated with high packaging and dispatch costs. Even a dispatch in non-assembled state can not substantially facilitate handling, especially as only the weight to be carried can be reduced by this, but not the bulkiness of the rigid rear panel and the advertisement support panel caused by the dimensions of the latter.

Transportation of the advertisement boards, if applicable, to varying installation locations is very expensive with dimensions of for example 5 m×3 m. If, for example, the light box is installed as an illuminated advertisement support in large department stores and is to be installed in different departments on different floors of the department store due to seasonal use, it may be necessary to carry the light box via a stairway or an escalator. The rigid format of the previously known light boxes is very disadvantageous since it limits the dimensions of the light box to the local circumstances such as e.g. the clear height in the escalator area.

In order to solve the problem of transportation and of packaging and dispatch costs, the applicant has been offering for a considerable time non-illuminated, modularly changeable advertising supports which comprise four base profiles which can be assembled such that in the assembled state they form a closed base frame into which the advertisement support can be inserted. Base profiles and advertisement supports can be dispatched and transported in an unassembled state so that a transport and a re-assembly is very simple, even on different floors of a department store. Furthermore, by changing two base profiles the base frame may easily be adapted to any change in format of the advertisement support. In this way, advertising areas with formats of up to 3 m×10 m can be provided.

However, with light boxes, this type of simple change to the format of the base frame is not possible in the prior art. Transportation in this way can not be implemented easily either because a support wall normally is formed on the rear side of the light boxes in order to be able to attach illuminants required for the illumination and electronic series connection units required for the power supply. This supporting wall therefore represents the element defining the minimum dimensions of the modular components of the light box to be transported. Moreover, it is necessary to change the rear panel if the format of the tensible plane material to be illuminated has to be changed because otherwise only parts of the light box would be equipped with illuminants and so a homogeneous illumination of the tensible surface element could not be guaranteed. Furthermore the assembly of the illuminants known in the prior art does not sufficiently meet the official safety criteria such that assembly and dismantling may only be carried out by professional electricians.

It is therefore an object of the present invention to provide a light box which can be assembled and dismantled easily, and at the same time offers the greatest flexibility possible when being transported by taking up as little space as possible.

This object is fulfilled according to the invention in that the supporting wall is formed by a second, tensible plane material which can be attached to the base frame in that it forms the rear side of the light box.

In other words, the illuminants and/or the electrical series connection unit is attached to a tensible plane material attached to the base frame and onto which the attachment means are provided for releasably fixing the illuminant and/or the electrical series connection unit within the base frame and which for transportation can be simply rolled or folded up after the light box has been dismantled. This tensible plane material can be made up or one or more parts, and may for example comprise two or more individual tensible surface elements.

If the format of the light box is to be changed, a further tensible plane material, which is adapted to the dimensions, can simply be fitted into the changed base frame. For example, therefore, the person installing this type of light box can simply order the corresponding flexible rear panel from the manufacturer, if appropriate together with the new advertising print to be illuminated, and this can be sent by post in a standard parcel or package. It is no longer necessary to construct a completely new light box for a different format. Instead, the change in format is achieved by changing two profiles and the two tensible surface materials. In this way, a practically limitless scalability of the light boxes can be achieved to suit the advertising print to be illuminated. This results in considerable cost savings.

Furthermore, in order to be able to guarantee a homogeneous illumination, when elongating the base frame, for example, further lighting elements are releasably attached to the attachment rail which is also elongated.

If, at a later state, an advertisement support with a smaller format is to be clamped into the light box, the longitudinal profiles are replaced by shorter longitudinal profiles, and any illuminants no longer required due to the reduction in length are removed and the rear tensible plane material is correspondingly shortened. Since the lights can be of different lengths, for example 580 mm, 880 mm, 1180 mm and 1480 mm, both the height and the length of the base frame can be adapted to the format of the advertisement support to be fitted in.

In order to achieve this type of scalability, it is advantageous to align the illuminants at right angles to the tensible plane material. The illuminants can of course also be disposed parallel to the tensible plane material depending on how the optimal illumination of the light box can be achieved best.

The releaseable connection of the illuminant to the tensible plane material can be implemented by means of a snap-lock connection and/or an engagement connection and/or a clamp connection and/or a connection by means of a hook and loop fastener or any other fastening means known in the state of the art.

A very easy and rapid disassembly is achieved by a connection by means of a hook and loop fastener. For this, strips of Velcro can be provided on the illuminants which form a hook and loop closure with strips of Velcro disposed on the length-variable plane material. The tensible plane material can also be formed by the strips of Velcro themselves. This enables a particular fast and simple assembly of the light box, even in locations with difficult access, and which due to the simple execution can be undertaken by a single person.

In order to satisfy the prescribed safety requirements, it is advantageous if the illuminants can be fixed in position by means of a safety device, in particular a locking loop which prevents accidental release of the illuminants from the plane material. In this way, the expandable surface material is prevented from being damaged by an inevitable release of an illuminant.

In a further exemplary embodiment the illuminants are connected to one another by means of a ready-assembled connector system in series connection. In this way, up to forty illuminants can be connected in series (depending on the light type, this corresponds to approx. 1000 W), and this enables scaling of the base frame up to a size of 3 m×10 m without the need to fit any further power supply to the light box.

A wiring can be implemented using prefabricated wires of different lengths to which light connectors are fitted so that a connection is made from illuminant to illuminant simply by inserting the light connectors. If the number of illuminants is to be increased, it is only necessary to attach a corresponding wire to the final illuminant in the series connection and to connect this to further illuminants. In this way, up to forty illuminants can be connected in series to a power connection. Due to the different wire lengths, it is also possible to fix the illuminants to the attachment rail with different distances separating them according to the installation requirements and the intensity of the illumination.

For safety reasons, when using light boxes with textile coverings it must be guaranteed that that passers-by or customers can at no time come into contact with current-carrying parts or that anybody could be injured by falling into the light box if, for example, an illuminant is broken. To this purpose, in one exemplary embodiment the illuminants are surrounded by a casing so that if the illuminant is broken, the components which could cause injury, such as for example splinters of glass, remain in this casing.

In order to have a positive effect upon the durability of the tensible plane material fitted in the base frame, in one exemplary embodiment of the present invention the illuminants can be provided with a UV filter. This filter can also be integrated into the casing.

A particularly simple type of attachment of the tensible plane materials to the base profile is achieved in that the plane material has clamping means by means of which it can be fitted in the base profile. The clamping means can, for example, be clamping frames to be pulled onto the base profile or extendable reinforcement strips, e.g. made of silicone, formed on the peripheral region of the tensible plane material which may be fitted into grooves formed in the base profile. This type of attachment is already known, for example, from the fabric frame system marketed by the applicant. In this system, the base profiles are to be provided with a continuous groove on their front and/or rear side into which the expandable plane material can easily be fitted. The tensible plane material is automatically tightened by fitting it into the base frame.

If corresponding grooves are provided in the base profiles on both the front and the rear side, it is possible to apply expandable plane material to both sides of the light box so that the light box can also be suspended from a ceiling and the advertising print on the plane material or the plane material itself is visible from different positions and the light box can be equipped with advertising prints from two sides.

Alternatively, to attach the second flexible tensible plane material to the base frame it is possible to flip the peripheral region of one side of the plane material in a way, that a loop is formed at the peripheral region of the plane material. Then this loop may be drawn over a cross rail almost like a curtain rail to fasten the tensible plane material to the base frame or the light box respectively and afterwards the cross rail may be fastened to the base frame. Of course, the cross rail may be permanently fastened to the base frame and may be moved in a position, for example by use of a hinge, in which an easy mounting of the supporting wall to the cross rail is possible. In this case the tension of the supporting wall is created by a kind of self tensioning either because of its dead weight or may be further supported and increased by additional weights being attached to the opposite peripheral region of the supporting wall.

A further possibility of fastening the supporting wall to the light box or the base frame respectively can be provided by at least two hooks being mounted on the corner area of the base frame, on which in particular eye enforced recesses within the supporting wall may be slided.

In a further exemplary embodiment a Velcro stripe is provided at least at the upper region of the base frame on at least one of the side walls of the base frame in particular along the entire length of the side wall, which is build complementary to a Velcro stripe at the supporting wall so that fastening of the supporting wall may be conducted by simply pressing both Velcro stripes onto each other. Of course the Velcro stripe at the base frame may extend at least partially along the side faces of the base frame or may be provided in a way that the supporting wall seals the interior of the light box against the surrounding by an end-to-end Velcro stripe attached at the base frame.

In both last named fastening principles the tension of the supporting wall is created by its dead weight and/or is supported and increased by additional weights being attached to the opposite peripheral region of the supporting wall, too.

Of course it is possible to fasten the supporting wall to the base frame or to the light box by other equally acting fastening means such as snap-lock connections or form-fit connections without going beyond the scope of the invention.

In order to attach the attachment means of the illuminants and/or the electronic series connection unit to the second tensible plane material which means to the supporting wall, in one exemplary embodiment recesses can be formed in the second tensible plane material into which the pins, which are formed on the attachment means, can be fitted and can be fixed in position outside of the space to be illuminated by pushing up counter means. Another alternative type of attachment of the attachment means on the tensible surface material can be made possible, for example, by means of adhesives, rivets, snap fastener connections, hook and loop fasteners and other attachment types known in the prior art.

In order to improve the scalability of the light box and in order to provide a particularly simple possibility for assembly which allows an installation and detachment by others then experts such as e.g. a stand builder or electrician, in one exemplary embodiment it is proposed that the illuminants can be connected to one another in series by means of a ready-assembled connector system, wherein all parts supplying current being inaccessible to the fitter. In particular, in this type of connector system two illuminants may be operated by one electronic series connection unit respectively.

In a further exemplary embodiment of the present invention at least one cross member can be fitted into the base frame such that it reinforces and stabilises the base frame and/or the second tensible plane material, in particular in the area of the attachment means. This cross member can be disposed outside of the space to be illuminated being formed by the two tensible plane materials and the base frame so as not to have any negative effect upon the space to be illuminated as a result of a possible shading.

Recesses may be formed into the cross member to complement recesses in the second tensible plane material in order to pass the attachment means both through the tensible surface material and through the cross member before they are fixed in position by counter means. Both the recesses in the cross member and the recesses in the plane material can be further reinforced by additional lugs and be secured against tearing out.

In order to simplify the assembly for the end-user, in a further exemplary embodiment of the present invention the electronic series connection units required to supply power can already be pre-assembled on the second tensible plane material. Furthermore, the fixing points required for fixing the attachment means may already be preset in the second tensible plane material, for example in the form of recesses or in the form of markers or adhesion points, where e.g. by pulling away a protective film the adhesive surface for fixing the attachment means is exposed, so that for the attachment, the attachment means are fitted and fixed in position by counter means, and the illuminants are then releasably fitted to the attachment means. Of course, it is equally possible to also fully pre-assemble the attachment means to the second tensible plane material. Combinations of the possible attachment types and pre-assembly states of the electronic series connection units and attachment means are also conceivable. Pre-assembling of the illuminants is also possible, but when transported correspondingly, the risk of the illuminants being damaged is relatively high.

A further embodiment of the present invention proposes that the supporting wall almost fully reflects the light irradiated by the illuminant in order to achieve the highest possible yield of light output emitted by the illuminants. Alternatively, the supporting wall can also be designed so that the light irradiated from the illuminant transforms into a colour effect on the rear side of the light box so that this colour effect can also be seen outside of the light box, for example a type of ambi-light can be seen in the surrounding area of the light box and so, if appropriate, the effect of the light box is further intensified for the observer by the additional colour.

In a further exemplary embodiment the tensible plane material is in particular a woven or knitted textile which is for example printable in dyesublimation print. The great advantage of this type of material is on the one hand its flexibility and foldability. On the other hand it is also possible to post large formats in small envelopes. When using synthetic sheets as the tensible plane material, it should be noted that the sheets must be dispatched, carefully rolled, because when folded kinks occur which then remain visible when the synthetic sheets are fitted into the base frame. This is not necessary when using a textile material because it can be chosen to be crease-resistant.

A further advantage of using fabric is that no reflections are produced on the plane whereby trouble-free observation of the advertising print without any reflection due to external light sources is required. The acoustic characteristics of the light box are also positively effected by the use of textiles as printed advertisement supports because the material reflects noises, especially high frequency noises, less strongly than do panes of glass, plexiglass panels or sheets. If optimisation of the production costs is of paramount importance, the use of synthetic sheets or similar is to be given priority.

Figure 2:
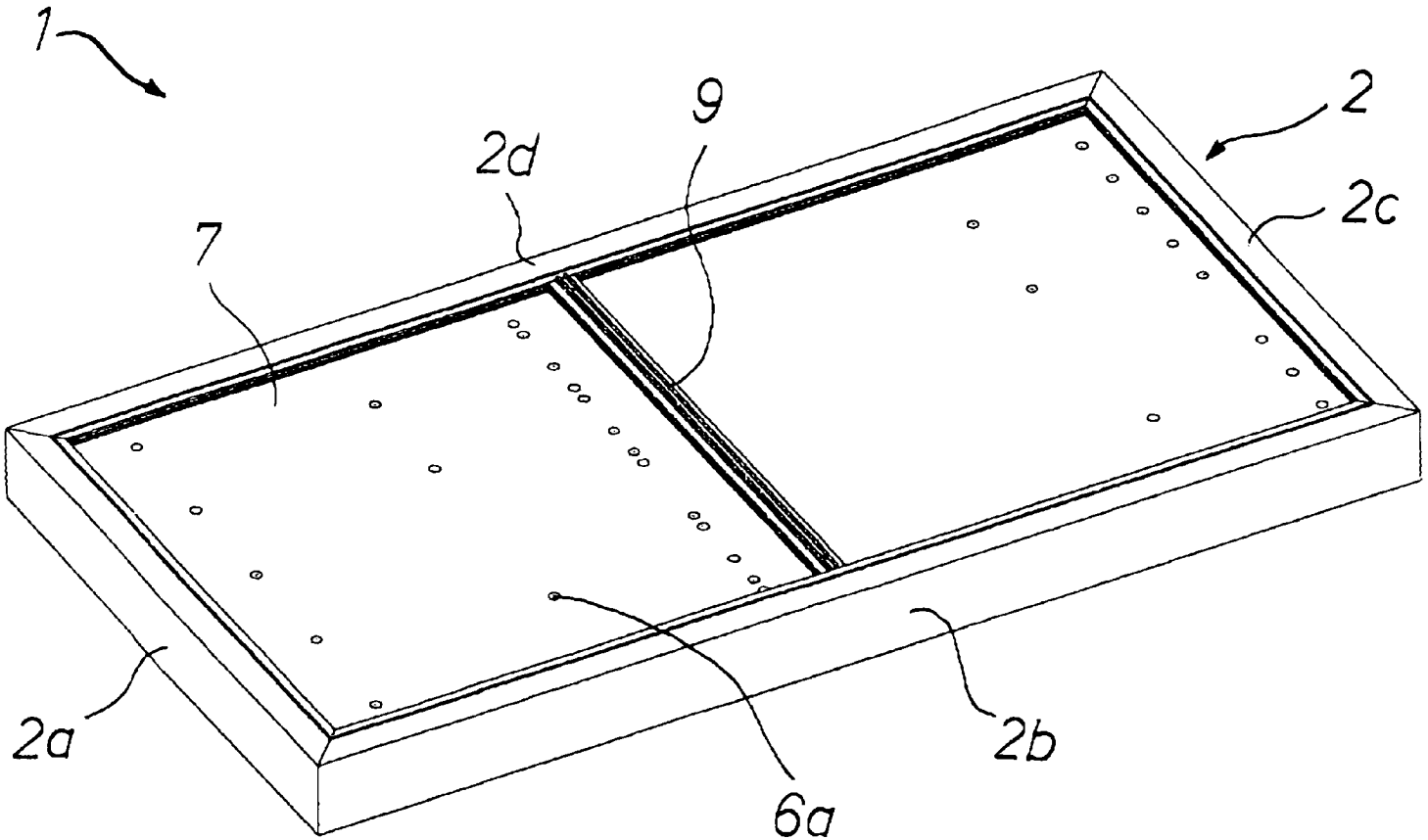
Figure 3:
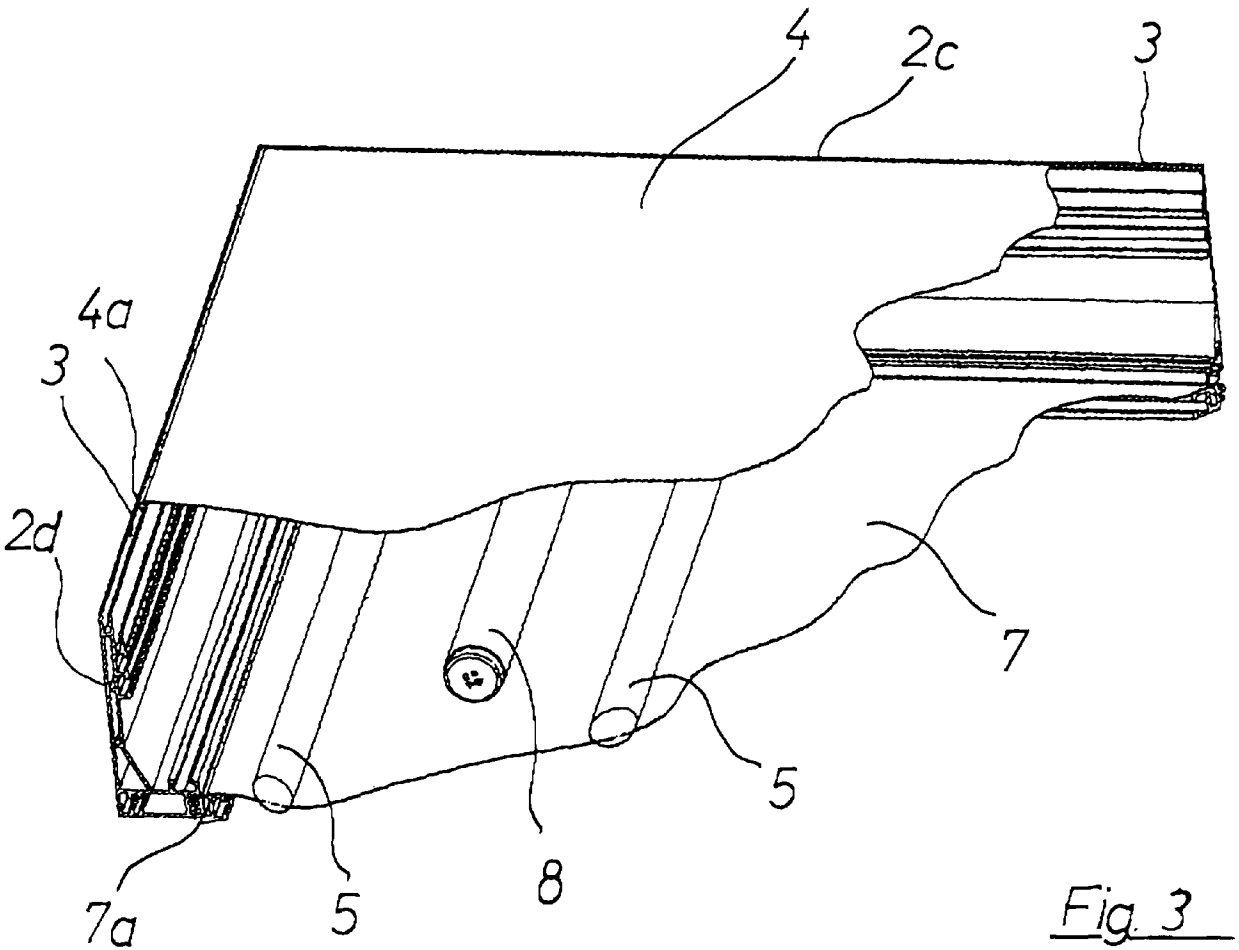
Figure 4:
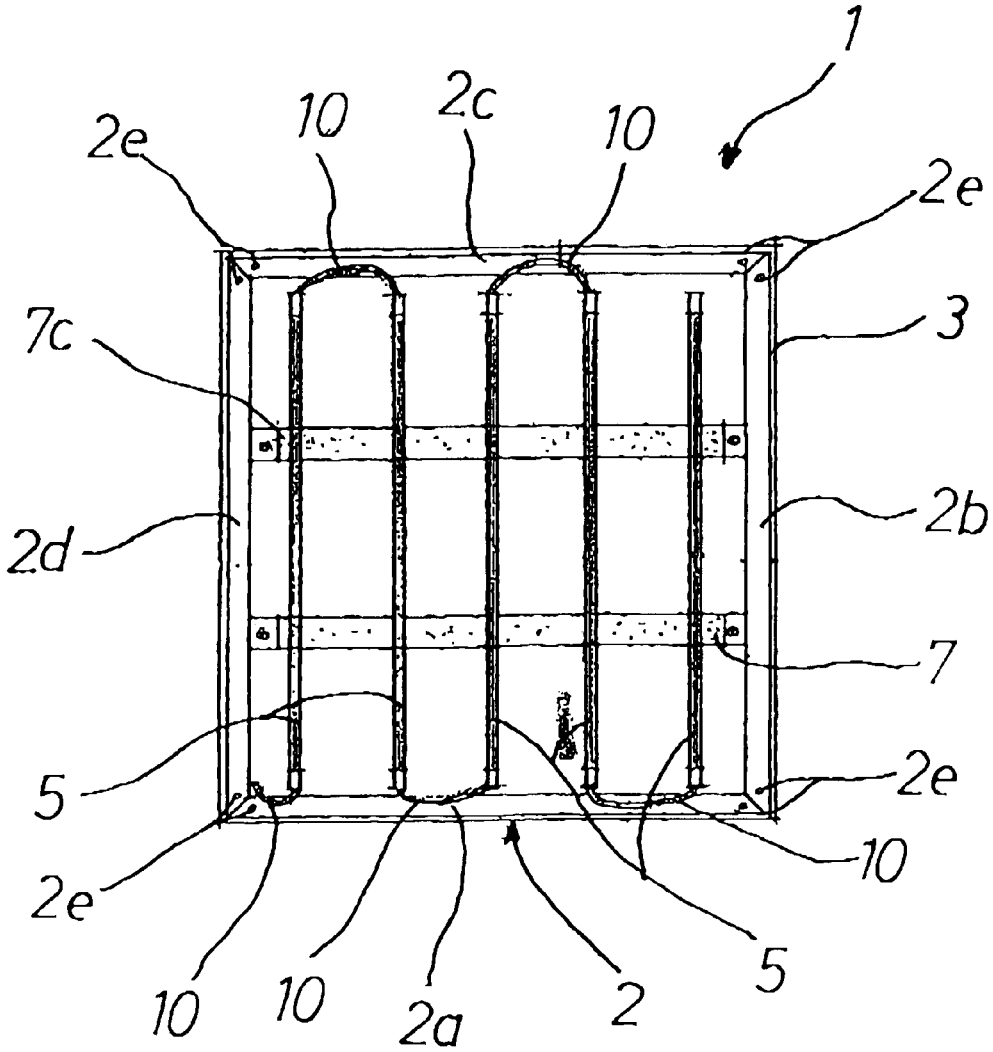

With regard to further advantageous embodiments and further developments of the invention, reference is made to the sub-claims and the following description of an exemplary embodiment using the attached drawings. These show as follows:

FIG. 1 a schematic, perspective view of a light box according to the invention;

FIG. 2 a schematic, perspective view of a light box according to the invention according to FIG. 1, seen from below;

FIG. 3 a schematic, perspective part-illustration of a light box according to the invention according to FIG. 1; and FIG. 4 a schematic view of a light box according to the invention with a multiple flexible tensible plane material.

FIG. 1 shows a light box 1 with four base profiles 2*a*, 2*b*, 2*c*, 2*d* which are connected to each other by hexagon socket screws 2*e* so that they form a closed base frame 2. The base profiles 2*a*, 2*b*, 2*c*, 2*d* are made of aluminium and so have great stability in relation to a relatively low weight.

On the front side of the base frame 2 a circumferential groove 3 is formed into which a first tensible plane material 4 (FIG. 3) can be fitted with its extendable reinforcement strips 4*a* made of a flexible material, such as for example silicone, formed in its peripheral region. Within the base frame 2, five illuminants 5 are attached by means of attachment means 6 to a supporting wall made of a tensible plane material 7. The illuminants 5 are supplied with current by three electrical series connection units 8 also fixed in the tensible plane material 7 by the attachment means 6. One such series connection unit 8 respectively supplies two illuminants 5.

In the present exemplary embodiment, on the right hand side of the light box 1 the series connection units 8 and illuminants 5 are already placed in their position pre-determined by the attachment means 6 and can be releasably fixed onto the flexible plane material 7 by simply clipping them into the attachment means 6—here in the form of attachment clamps.

As may be clear from the left hand region of the light box 1, in this exemplary embodiment the attachment means 6 are already pre-assembled to the tensible plane material 7. Of course, it is possible to also pre-assemble the series connection units 8 and/or the illuminants 5 in order to further facilitate assembly of the light box 1 by non-experts and to further reduce any possible causes of faults during assembly.

On the rear side of the light box 1 a reinforcement member 9 (see FIG. 2) is provided in order to stabilise the base frame 2 and/or the tensible surface material 7.

The assembly procedure for the light box is as follows:

First of all, the four base profiles 2*a*, 2*b*, 2*c*, 2*d* are connected to one another by means of connectors and fixed in position in relation to one another by means of connectors, screw fastenings or snap-on connections. Of course other types are conceivable for fixing them in position in relation to one another, such as for example bolt attachments or similar. Next, the supporting wall 7 in the form of a second tensible plane material is fitted in the base frame 2. Attachment means 6, here in the form of attachment clamps, are already pre-assembled to the supporting wall 7 by fitting them in the recesses formed in the supporting wall 7 and then fixing them in position by means of counter means 6*a*.

Next, the electrical series connection units 8 are respectively fitted in the position established by the distance between the attachment elements between two attachment points of the illuminants 5, in the present case they are simply clipped into the attachment clamps 6. In this exemplary embodiment the attachment means 6 of the series connection units 8 are fixed to the supporting wall by means of a heat-stable adhesive because the series connection units remain on the supporting wall 7 once they have been mounted. Of course, any other attachment means known in the prior art such as screws, rivets, welds or similar are equally conceivable.

Next, the connector attachments 8*a* being provided with wiring of different length are slided onto the ends of the illuminants 5, afterwards the electrical series connection units 8 are connected to one another, in particular in series connection, and attached to the contacts provided in the base frame 2 for supplying power to the electrical series connection units 8. The light box 1 is then supplied with electrical current by means of a central supply line (not shown) which may finally be supplied with current by means of a conventional socket. Finally, the light box 1 is covered with the tensible plane material 4 to be illuminated, the latter being fitted in the circumferential groove 3 being provided in the base frame 2 with reinforcement strips 4*a* formed in its edge region. The light box 1 can then be suspended in the desired position by means of hanging devices (not shown), such as for example hooks or wires, formed in the base frame 2.

FIG. 3 shows a schematic part-illustration of a light box 1 according to the invention, on the supporting wall 7 of which the electrical series connection units 8 required for the power supply and the attachment means 6 for the illuminants 5 are already pre-assembled. In the edge region of the tensible plane material 7 reinforcement strips 7*a* are formed which can be fitted in the circumferential groove 3 formed in the base frame 2 for attachment and for establishing a tension enhancing the supporting function of the supporting wall 7.

The attachment means 6 can be attached in different ways to the supporting wall 7. On the one hand they can be simply adhesively bonded at certain positions or attached, for example, by means of hook and loop fasteners. Alternatively, it is also possible for the attachments means to be in the form of a pin which can be passed through recesses formed in the supporting wall 7, and fixed in position by counter means 7*a* being placed at the outside of the space formed by the two tensible plane materials 4, 7 and the base frame 2. In order to prevent the tensible plane material 7 from tearing out, in the region of the recesses reinforcement lugs are provided which are designed such that the attachment means 6 totally cover them in the assembled state so that no light passes undesirably to the outside.

If the position of the illuminants 5 in the light box 1 is to be changed, it is possible to seal the existing recesses simply by applying a piece of material and to form a new recess at another desired position, for example by punching.

The tensible plane material 7 is made of a woven or knitted textile which, for example, can be printed in dyesublimation print. The material used is a particularly densely woven polyester fabric which is characterised by its flexibility and foldability. It is therefore possible to also post large advertisement supports in small envelopes. Due to the lower weight of the material in relation to the plexiglass panels used for advertising supports in the prior art, the light box 1 can be assembled or the advertising print can be changed by just one person. The surface of the material used is totally reflection-free, and this enables trouble- and reflection-free observation of the advertising print so that the light box can be installed in any vicinity without taking into consideration the illumination surroundings. The use of materials also has a positive effect upon the acoustic characteristics in a room because the noise of the room is also reflected substantially less, especially with high frequencies.

In an alternative exemplary embodiment (not illustrated) the tensible plane material 7 is in the form of a synthetic sheet which is carefully rolled up for transportation in order to avoid kinks.

In a further embodiment not shown the peripheral region of one side of the tensible plane material 7 is flipped in a way, that a loop is formed at the peripheral region of the plane material 7 to attach the second plane material 7 to the base frame 2. This loop may be drawn over a cross rail almost like a curtain rail to fasten the tensible plane material 7 to the base frame 2 or rather the light box 1 and afterwards the cross rail may be fastened to the base frame 2. Of course, the cross rail may be permanently fastened to the base frame 2 and may be moved in a position for example by use of a hinge, in which an easy mounting of the supporting wall 7 to the cross rail is possible. in this case the tension of the supporting wall 7 is created by kind of self tensioning either because of its dead weight or may be further supported by additional weights being attached to the opposite peripheral region of the supporting wall 7.

A further possibility of fastening the supporting wall 7 to the light box 1 or the base frame 2 can be provided by two hooks being mounted on the corner area of the base frame 2, on which in particular eye enforced recesses within the supporting wall 7 may be slided. Alternatively or supplementary a Velcro stripe is provided at least at the upper region of the base frame 2 on at least one of the side walls of the base frame in particular along the entire length of the side wall, which is build complementary to a Velcro stripe at the supporting wall 7 so that a fastening of the supporting wall 7 may be conducted by simply pressing both Velcro stripes onto each other. The tensioning of the supporting wall 7 may in both last named principles either be created by its dead weight or/and may be supported and increased by additional weights being attached to its opposite peripheral or edge region. If an end-to-end Velcro stripe is provided at the base frame 2 the tensioning may be created by pressing both Velcro stripes to each other Of course it is also possible to fasten the supporting wall 7 to the base frame 2 or rather the light box 1 by equally acting fastening means such as snap-lock connections or form-fit connections without going beyond the scope of the invention.

A further exemplary embodiment as shown in FIG. 4 proposes that the tensible plane material 7 is made of multiple parts, in particular in the form of flexible cross members 7*c*, 7*d* which may, if appropriate, be of changeable length, and which are fitted into the base frame 2.

Two tensible plane materials 7*c*, 7*d* in the form of two textile Velcro stripes of changeable length and therefore adjustable to the geometrical extensions of the base frame 2 are placed between two profiles 2*a*, 2*c*.

In FIG. 4, five illuminants 5 are fitted within the base frame 2. T5-gas discharge lamps are used as illuminants. On their side facing towards the textile strips 7*c*, 7*d*, the illuminants 5 have a further Velcro strip respectively which, together with the Velcro strip of the textile strips 4 forms hook and loop fastening. In this exemplary embodiment the illuminants 5 are aligned at right angles to the textile strips 7*a*, 7*b* and connected to one another by means of a pre-assembled connector system in series connection. Of course, the illuminants 5 can also be disposed parallel to the textile strips 7*c*, 7*d* depending on how optimal illumination of the light box 1 can be achieved best.

The pre-assembled connector system is made up of prefabricated wires which form a connection between the individual illuminants 5 with standard connectors (not shown). The wires are available in different lengths so that different distances can be implemented between the illuminants 5 or the illuminants can also be disposed next to one another in two parallel rows. It is possible to connect up to forty illuminants 5 in series to one power connection.

After this the illuminants 5 are fitted in the base frame 2 and then fixed simply by being pressed with their Velcro strips onto the Velcro strips of the textile strips 7*c*, 7*d*. By using Velcro strips on the illuminants 5 and on the textile strips 7*c*, 7*d* the light box 1 can be particularly quickly dismantled and it can be conveyed easily so that the light box 1 can also be assembled at locations with difficult access and also by just one person. Attachment by means of engaging elements on the illuminants 5 and engaging rails on the attachment rails 4 or by clamps on the illuminants 5 which enclose the latter or are pushed onto the latter so as to attach the illuminants 5 to the attachment rails 4 is also conceivable.

Depending on the desired illumination pattern every second tube may be fixed to the attachment rails 4 rotated about 90° so that the latter are located in a side position in the base frame 2. Next, the reinforcement strips made of silicone formed on the textile advertisement support (not shown) are fitted in the groove 3 of the base frame and pressed onto the base frame 2.

If, for example, due to seasonal installation another advertisement support is to be fitted in the light box 1 at a later stage and which is of a different format, having for example a greater length, the profiles 2*b* and 2*d* disposed on the long sides are simply exchanged for profiles which are of a length which corresponds to the length of the new advertisement support to be fitted. Furthermore, in order to be able to guarantee homogeneous illumination of the light box 1, additional illuminants 5 are fitted in the base frame 2 in accordance with the elongation of the light box 1 and are simply attached to the illuminants 5 already provided in series connection, and pressed onto the textile strips 7*c*, 7*d*.

If the base frame 2 is now to be shortened due the advertisement support to be fitted having a smaller format, the profile bars 2*b* and 2*d* are removed again and replaced by shorter profile bars. The textile strips 7*c*, 7*d* are then shortened to the length of the changed profile bars, and the number of lightning elements 5 is correspondingly reduced simply by withdrawing the connector from the series connection.

If the change of the format necessitates a change to the height of the light box 1, the profile bars 2*a*, 2*c* are replaced by profile bars the length of which corresponds to the desired height of the light box 1 and fully replaces the whole set of illuminants 5 connected in series by illuminants of appropriate length.

Of course it is also possible, after changing the height of the light box 1, to also form the textile strips 7*c*, 7*d* between the profile bars 2*a* and 2*c* and to dispose the illuminants 5 simply at right angles to the latter, i.e. extending in the longitudinal direction of the light box 1 instead of totally changing the illuminants 5 if, due to the format of the advertisement support or of the base frame 2 more advantageous illumination of the light box 1 is achieved. Furthermore, the advantage of this is that a further complete set of illuminants of appropriate length does not have to be obtained purely as a result of a change in format of the advertisement support. A further possibility for dealing with a change in format is to dispose the illuminants parallel to one another in two or more rows, it being possible for them either to be connected in series one behind the other, or also connected in parallel.

Due to the exchangeability of the individual base profiles in combination with the adaptability of the supporting wall and the tensible plane material 7 and the number and/or position of the illuminants 5 in the light box 1, almost limitless scalability of the light box 1 is possible. Light boxes with dimensions of up to 3×10 m can therefore be formed, and precisely this makes it attractive to use these light boxes in the domain of airports and large fashion stores. In this exemplary embodiment the tensible plane material 7 is designed to be as reflective as possible.

In an alternative exemplary embodiment (not illustrated) the tensible surface material 7 is also designed to be translucent so that it transforms the light irradiated by the illuminants 5 into a colour effect when it passes out of the rear side of the light box 1. If, for example, the area surrounding the light box 1 is to take on a reddish appearance corresponding to the chosen advertising print on the front side, the tensible plane material 7 can be designed such that the light passing through the supporting wall has a red appearance.

By means of a supporting wall arrangement 11 according to the invention, which comprises at least one tensioning system and one tensible plane material 7, the supporting wall according to the invention can also be used in already existing profile systems, in particular in the field of stand constructions and publicity displays. If an already existing system has a circumferential groove in the peripheral region of its base profile, the supporting wall can be fitted in the groove by means of corresponding tensioning systems such as e.g. reinforcement strips.

If, however, this is a conventional profile without a corresponding groove, it is also possible to attach the tensible surface material to the base frame, for example by means of a clamping frame which can be placed on the base profile. By means of the possibility of retrofitting, already existing systems can also be designed to be more flexible as regards transportation and as regards their scalability.

The invention claimed is:

1. A light box with at least three base profiles which in the assembled state form a closed base frame onto which a first tensible plane material to be illuminated can be fitted such that it forms the a front side at least one illuminant which is disposed within the base frame in order to illuminate the light box, at least one power supply, at least one supporting wall disposed on the base frame which has at least one attachment means for releasably fixing the illuminant and/or the power supply within the base frame, characterized in that the supporting wall is formed by a second, tensible plane material which can be attached to the base frame such that it forms a rear side of the light box, wherein the first and second tensible materials are woven or knitted textile.

2. The light box according to claim 1, characterised in that the first and/or second tensible plane material can be fitted in the base profile by clamping means.

3. A supporting wall arrangement for a light box according to claim 2, wherein the clamping means comprise reinforcement strips formed on a peripheral region of the tensible plane material.

4. The light box according to claim 1, characterised in that the illuminant is releasable connected to an attachment rail via at least one of the following: a snap-lock connection: an engagement connection; a clamp connection; or a connection by means of a hook and loop fastener.

5. The light box according to claim 1, characterised in that at least one recess is provided for mounting the attachment means to the second tensible plane material in which the at least one attachment means can be fitted.

6. The light box according to claim 5, characterised in that a pin is formed on the attachment means which, in order to attach the attachment means can be passed through the recess formed on the tensible plane material and can be fixed in position by counter means outside of a space to be illuminated within the light box.

7. The light box according to claim 1, characterised in that the illuminants can be connected to one another in series by means of a ready-assembled connector system.

8. The light box according to claim 1, characterised in that the tensible plane material is made up of several parts in the form of flexible cross members, the length of which in particular is changeable, which can be fitted into the base frame.

9. The light box according to claim 1, characterised in that at least one reinforcement member can be fitted into the base frame in order to reinforce the base frame and/or the second tensible material in the region of the attachment means.

10. The light box according to claim 1, characterised in that the geometric dimensions of the base frame can be adapted to the dimensions of the first and second tensible plane material by changing at least two profiles with profiles having different dimensions.

11. The light box according to claim 1, characterised in that the supporting wall formed by the second tensible plane material reflects the light irradiated by the illuminant or transforms it into a colour effect on the rear side of the light box.

12. A supporting wall arrangement for a light box according to claim 1, characterised in that the supporting wall is formed by a plane material tensionable by clamping means, on which at least one attachment means is disposed for the releaseable fixing of at least one illuminant and/or at least one electrical series connection unit.

13. A supporting wall arrangement for a light box according to claim 1, wherein the power supply comprises an electrical series connection unit in order to supply the illuminant with current.

14. The light box according to claim 13, characterised in that the at least one electrical series connection unit required for the power supply is pre-fitted on the second tensible plane material.

15. A supporting wall arrangement for a light box according to claim 1, wherein the illuminants comprise at least two illuminants respectively operable by one electrical series connection unit.

* * * * *